US008210371B2

(12) United States Patent
Kim

(10) Patent No.: US 8,210,371 B2
(45) Date of Patent: Jul. 3, 2012

(54) BASKET FOR REFRIGERATOR AND MOUNTING APPARATUS FOR THE BASKET

(75) Inventor: Do-Hyung Kim, Changwon (KR)

(73) Assignee: LG Electronics Inc., Seoul (KR)

( * ) Notice: Subject to any disclaimer, the term of this patent is extended or adjusted under 35 U.S.C. 154(b) by 419 days.

(21) Appl. No.: 12/442,679

(22) PCT Filed: Oct. 23, 2007

(86) PCT No.: PCT/KR2007/005215

§ 371 (c)(1),
(2), (4) Date: Mar. 24, 2009

(87) PCT Pub. No.: WO2008/051002

PCT Pub. Date: May 2, 2008

(65) Prior Publication Data

US 2010/0018242 A1 Jan. 28, 2010

(30) Foreign Application Priority Data

Oct. 26, 2006 (KR) ..... 10-2006-0104651

(51) Int. Cl.
*A47F 3/14* (2006.01)

(52) U.S. Cl. ..... 211/126.15; 211/133.5; 211/162; 312/402

(58) Field of Classification Search ..... 62/465; 211/85.4, 41.4, 41.8, 126.15, 133.5, 162, 211/181.1; 312/402, 404, 410, 334.7, 311
See application file for complete search history.

(56) References Cited

U.S. PATENT DOCUMENTS

| | | | | |
|---|---|---|---|---|
| 4,795,041 | A * | 1/1989 | Remmers | 211/126.15 |
| 5,480,035 | A * | 1/1996 | Smith | 211/41.8 |
| 5,860,716 | A * | 1/1999 | Good et al. | 312/311 |
| 5,980,009 | A * | 11/1999 | Atalla et al. | 312/408 |
| 6,491,173 | B1 * | 12/2002 | Costa | 211/126.15 |
| 6,643,900 | B2 * | 11/2003 | Jahrling | 24/563 |
| 6,938,784 | B2 * | 9/2005 | Yang | 211/87.01 |
| 2002/0033657 | A1 | 3/2002 | Kim et al. | |
| 2006/0152118 | A1 | 7/2006 | Lee | |

(Continued)

FOREIGN PATENT DOCUMENTS

CN 2407309 Y 11/2000

(Continued)

*Primary Examiner* — Darnell Jayne
*Assistant Examiner* — Stanton L Krycinski
(74) *Attorney, Agent, or Firm* — Birch, Stewart, Kolasch & Birch, LLP

(57) ABSTRACT

In order to accomplish the prevention of the shaking of the basket provided in a refrigerator, the fall prevention of the basket, the safe support of foods, the improvement of safety of the supporting portion of the basket, the improvement of user's sanitation and the improvement of appearance, the present invention discloses a mounting apparatus for a basket for a refrigerator comprising: a telescopic mounted on the wall of the refrigerator to be retractable; a connect member engaged with the telescopic; and a basket firmly seated on the upper surface of the connect member and provided with a plurality of bent wires, wherein, in order to support the position of the basket, the connect member comprises a right and left shake preventing part preventing right and left shakings of the basket; a front and rear shake preventing part preventing front and rear shakings of the basket; and a up and down shake preventing part preventing up and down shakings of the basket.

9 Claims, 2 Drawing Sheets

U.S. PATENT DOCUMENTS

2008/0054772 A1* 3/2008 Koloff et al. ..... 312/404

FOREIGN PATENT DOCUMENTS

CN 1340445 A 3/2002
CN 2531335 Y 1/2003
CN 1804521 A 7/2006
JP 6-257935 A 9/1994
KR 10-2002-0017015 A 3/2002
KR 10-2006-0081923 A 7/2006

* cited by examiner

[Fig. 1]
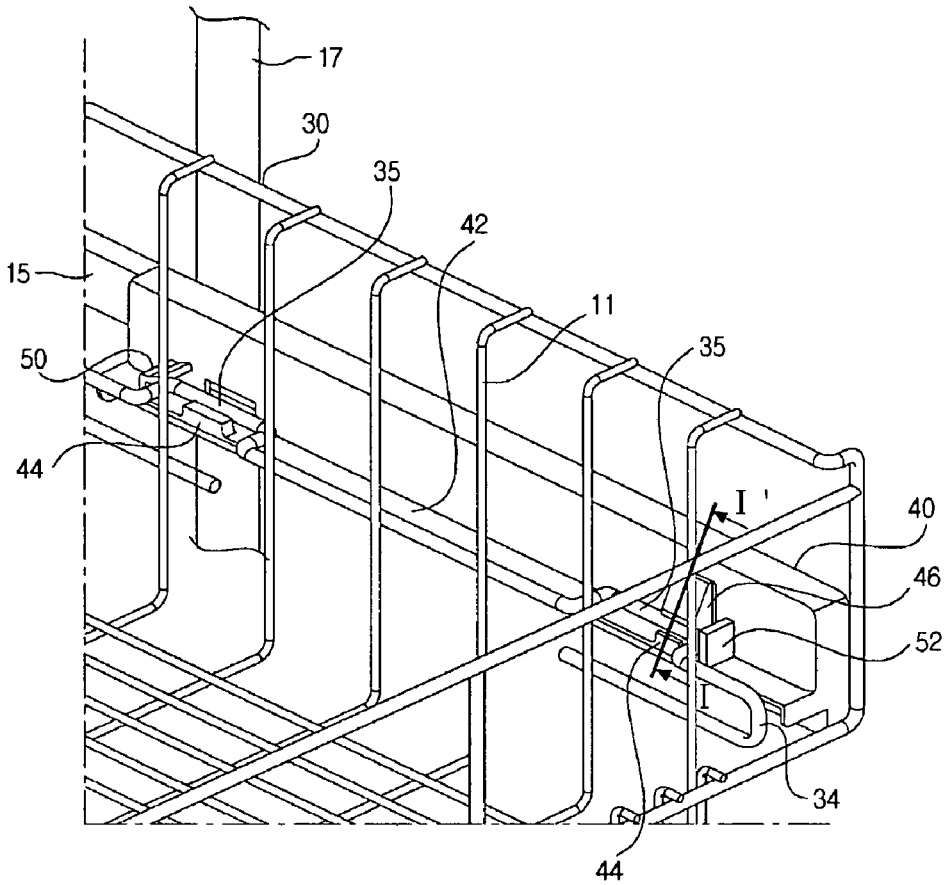
[Fig. 2]
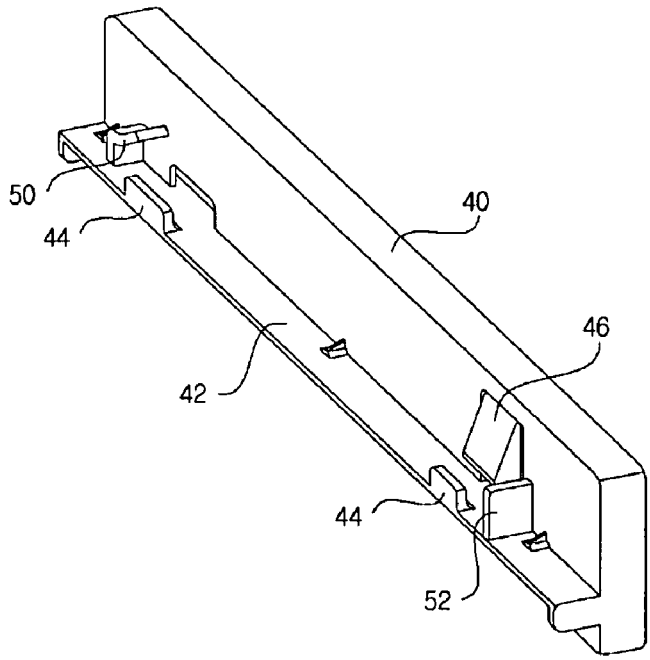

[Fig. 3]
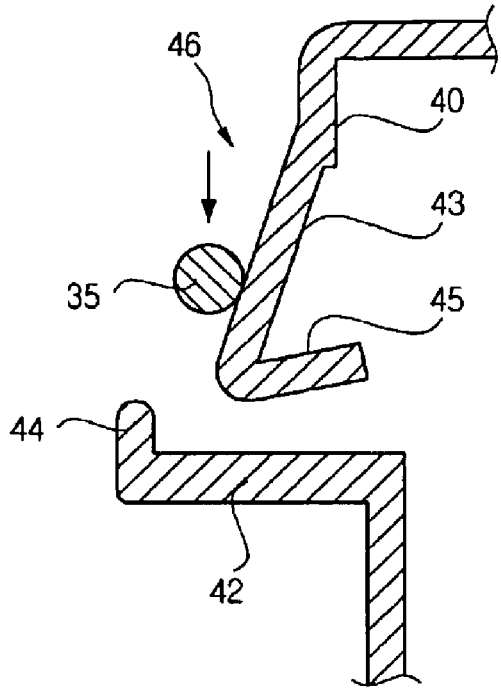
[Fig. 4]
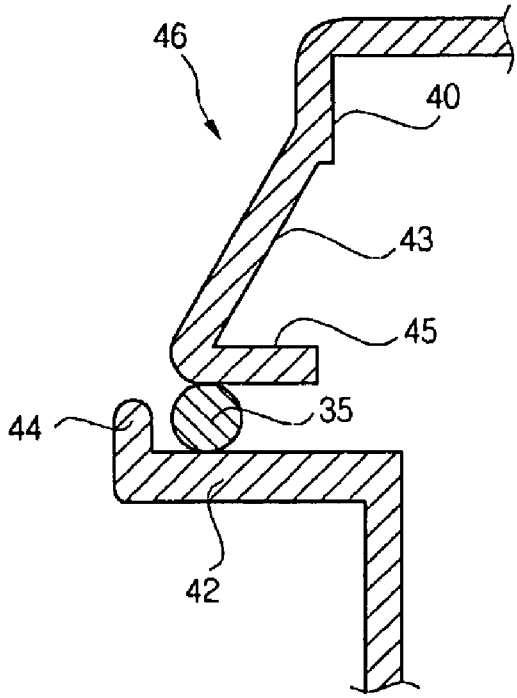

BASKET FOR REFRIGERATOR AND MOUNTING APPARATUS FOR THE BASKET

TECHNICAL FIELD

This document relates to a device provided in a refrigerator, and more particularly to a basket for a refrigerator and a mounting apparatus for the basket.

BACKGROUND ART

A refrigerator is a device storing low temperature stored articles such as foods, etc. The door of the refrigerator is generally connected to the side of the refrigerator main body by a hinge assembly to rotate the refrigerator main body centering on a hinge axis forward and backward. Differently therefrom, in a drawer-type refrigerator, a door is installed to be able to be drawn in and out forward and backward from a main body.

Meanwhile, the drawer-type refrigerator allows a basket installed in the inside of a storage space to move forward and backward in the state where the door thereof is opened so that a user can conveniently use the basket.

However, the existing used basket has a hook attached to its side to make the basket draw in and out in the state where the hook is caught by the rail of the inner wall portion of the refrigerator by the weight of the basket. Therefore, the basket is shaken when the basket operates to cause a problem that safety deteriorates. For example, by erroneously applying force when pulling the basket, it causes problems that the hook is taken off to pour the foods inside the basket or the basket is shaken to pour the foods inside the basket.

Also, it has a problem that a contact point of the hook portion is rubbed to make the coating of the hook come off. If a coating of resin material in the hook portion come off as above, it causes problems that metal inside thereof is revealed to outside to be not good in appearance and the metal rusts to have a bad influence on food sanitation.

DISCLOSURE OF INVENTION

Technical Problem

It is an object of the embodiment to provide a basket for a refrigerator and a mounting apparatus for the basket preventing a shaking of the basket generated when drawing in and out towards both inside and outside of a storage space of the basket and improving reliability of a supporting portion of the basket.

Technical Solution

A basket for a refrigerator according to the present invention comprises: a plurality of frame wires engaged with at least two or more directions and bent to provide a food receiving space; and a position fixing part comprising a hanging wire provided on at least one side of the frame wires, wherein the hanging wire is laterally projected to be firmly seated to the inner wall surface of the refrigerator.

A mounting apparatus for a basket for a refrigerator according to another aspect of the present invention comprises: a telescopic mounted on the wall of the refrigerator to be retractable; a connect member engaged with the telescopic to be freely movable; and a basket supported by the connect member, wherein the connect member comprises an elastic hook providing resistance to the basket when the basket is mounted and losing the resistance when the basket is completely mounted, and thereby instructing a user to completely mount the basket.

A mounting apparatus for a basket for a refrigerator according to another aspect of the present invention comprises: a telescopic mounted on the wall of the refrigerator to be retractable; a connect member engaged with the telescopic; and a basket of which side is provided with a position fixing part to be firmly seated to the connect member, at least one portion of the position fixing part being laterally projected, wherein, in order to support the position fixing part, the connect member comprises a right and left shake preventing part preventing right and left shakings of the position fixing part; a front and rear shake preventing part preventing front and rear shakings of the position fixing part; and a up and down shake preventing part preventing up and down shakings of the position fixing part.

A mounting apparatus for a basket for a refrigerator according to still another aspect of the present invention comprises: a telescopic mounted on the wall of the refrigerator to be retractable; a connect member engaged with the telescopic; and a basket firmly seated on the upper surface of the connect member and provided with a plurality of bent wires, wherein, in order to support the position of the basket, the connect member comprises a right and left shake preventing part preventing right and left shakings of the basket; a front and rear shake preventing part preventing front and rear shakings of the basket; and a up and down shake preventing part preventing up and down shakings of the basket.

A mounting apparatus for a basket for a refrigerator according to still another aspect of the present invention comprises: a telescopic mounted on the wall of the refrigerator to be retractable; a connect member engaged with the telescopic to be freely movable; and a basket supported by the connect member and provided with a plurality of bent wires, wherein at least one of the wires comprises at least a position fixing part laterally projected, and the connect member comprises a support rib preventing the position fixing part from moving to the opposite direction of the connect member.

Advantageous Effects

With the present invention, the shaking of the basket provided in a refrigerator is prevented, and the fall prevention of the basket, the safe support of foods, the improvement of safety of the supporting portion of the basket, the improvement of user's sanitation and the improvement of appearance are expected.

BRIEF DESCRIPTION OF THE DRAWINGS

FIG. 1 is a perspective view showing a preferable embodiment of a basket for a refrigerator and a mounting apparatus for the basket according to the present embodiment;

FIG. 2 is a perspective view of a connect member supporting a basket for a refrigerator; and FIGS. 3 and 4 are cross-sectional views of FIG. 1 taken along lines I-I' wherein FIG. 3 shows a state where the insertion of a position fixing part is processing, and FIG. 4 shows a state where the insertion of a position fixing part is completed.

BEST MODE FOR CARRYING OUT THE INVENTION

The preferable embodiments of a basket for a refrigerator and a mounting apparatus for the basket will be described in detail with reference to the accompanying drawings.

FIG. 1 shows a perspective view of a preferable embodiment of a basket for a refrigerator and a mounting apparatus for the basket according to the present embodiment, and FIG. 2 shows a perspective view of a connect member supporting a basket for a refrigerator.

First, referring to FIG. 1, various foods, etc. are stored inside a basket 30 installed in a storage space provided inside the refrigerator to be able to be drawn in and out. The basket 30 is a shape where a plurality of frame wires 11 are disposed at a pre-determined interval and bent and then coupled to be orthogonal to each other. Of course, the storage space capable of receiving food is formed in the bent inside.

Hanging wires 34 for hanging the basket 30 on a connect member 40 are provided on both sides of the basket 30. The hanging wire 34 is formed with at least one portion to be projected to the outer side of the basket 30 on both sides of the basket 30. And, the hanging wire 34 is mounted to be orthogonal to a wire forming both side portions of the basket 30. In other words, the wire forming the both side portions of the basket 30 is extended in up and down directions, however, the hanging wire 34 is extended in front and rear directions. The hanging wire 34 is provided with a pair of position fixing parts 35 formed by bending a portion thereof in an approximate '⊂' shape. The position fixing parts 35 are formed to be spaced forward and backward the basket 30 at a predetermined distance. Of course, the position fixing parts 35 can be formed with the various numbers thereof, not limiting to the number formed in the present embodiment.

On both sides of the storage space provided in the refrigerator, a telescopic 15 for guiding a drawing in and out of the basket 30 is mounted on a wall 17 of the refrigerator. A sliding rail of the members forming the telescopic 15 is generally formed to be further projected to the external of the storage space at a predetermined length. Thereby, the basket can be drawn in and out to the external of the refrigerator so that the use of the basket can be more convenient.

In the inner side of the sliding rail, each of the connect member 40 is coupled by means of screws, etc. The connect member 40 is a rectangular flap hexahedral shape where the cross-sections thereof are formed to be long up and down and is generally formed of synthetic resin material.

Referring to FIG. 2, a support rib 42 extending right and left directions is formed on one surface of the connect member 40. The support rib 42, which supports a low surface of the position fixing part 35, is provided with a pair of hanging ribs 44 on front and rear end portions of the upper surface at a predetermined distance. The hanging rib 44 plays a role to limit a horizontal move for the connect member 40 of the basket 30 in the state where the position fixing part 35 is hanging. In other words, the right and left move of the basket 30 can be entirely limited by the inner surface of the connect member 40 and the hanging rib 44. Of course, the use figure of such a safe supporting figure of the basket 30 can be varied according to the basket size, for example, when the basket 30 is sagged towards the bottom due to lots of things put inside the basket 30, the right and left width of the basket 30 can be reduced. In this case, since the position fixing part 35 can move even beyond the inner side end portion of the support rib 42, an advantage can be expected in that reliability for the safe support of the basket 30 is improved by means of the hanging rib 44.

The front one side of the connect member 40 is formed to be opened, and an elastic hook 46 for limiting the up and down move of the position fixing part 35 is provided in the upper of the opened portion. The elastic modification of the elastic hook 46 is available in view of the characteristics of the material and shape. The elastic hook 46 is in a triangle shape, seeing from the side (See FIG. 4).

The operation of the elastic hook 46 will be described in more detail. FIGS. 3 and 4 show cross-sectional views of FIG. 1 taken along lines I-I' wherein FIG. 3 shows a state where the insertion of a position fixing part is processing, and FIG. 4 shows a state where the insertion of a position fixing part is completed.

Referring to FIG. 3, a long side portion of a triangle is a guide part 43 guiding a position fixing part 35 when the position fixing part 35 is coupled, and being elastically deformed by the force pressing the position fixing part 35. And, a bottom side portion of the triangle is a hanging part 45 formed to be extended from the tip of the guide part 43 to the connect member 43. The hanging part 45 moves in the opened portion of the connect member 40 when the guide part 43 is elastically deformed. The hanging part 45 is adhered to the position fixing part 35 to play a role to prevent the shaking of the position fixing part 35, when the position fixing part 35 is mounted on the connect member 40.

Referring to FIG. 4, the hanging part 45, which is a portion to be adhered to the position fixing part 35, operates as a member to press the position fixing part 35. Of course, the hanging part 45 is put on the upper side of the position fixing part 35, not pressing the position fixing part 35, according to circumstances, so that it would be good for the hanging part 45 only to suppress the force moving the position fixing part 35 to the upper side.

Although the elastic hook 46 is shown in the present embodiment in order that only one thereof is formed in the connect member 40, it is not limited thereto but can be formed to correspond to the number of the hanging rib 44. Although the elastic hook 46 is proposed to be simultaneously molded when the connect member 40 is ejected, it is not limited thereto but acting effects that separate components are engaged, etc., can be sufficiently expected.

A hanging hook 50 is provided in the rear end of the upper surface of the support rib 42. The hanging hook 50 is formed to be positioned relatively in the rear compared to the hanging rib 44. And, the hanging hook 50 limits the up and down move of the position fixing part 35 firmly seated to the support rib 42. To this end, the hanging hook 50 is proposed in a shape where it is projected upward and then extended forward at a predetermined distance. And, the front end of the hanging hook 50 is slantly extended upward, where it is for safely guiding a basket when mounting the basket.

A stopper 52 projected upward is provided in the front end of the upper surface of the support rib 42. The stopper 52 is formed to be positioned relatively in the front compared to the hanging rib 44. And, the stopper 52 allows the front end of the position fixing part 35 formed relatively in the front of the position fixing part 35 to be adhered. Therefore, the front and rear move of the position fixing part 35 is limited.

Hereinafter, the operation of a mounting apparatus for a basket for a refrigerator according to the present embodiment having the constitution as described above will be described.

Seeing the process coupling the basket 30 to the connect member 40, first the position fixing part 35 positioned relatively in the rear is hung on the hanging hook 50 in the state where the rear end of the basket 30 is downwardly slanted. At this time, since the end portion of the hanging hook is upwardly and slantly formed at a pre-determined distance, the basket 30 can be firmly seated.

Next, the front end of the basket 30 downwardly rotates centering on the rear end of the basket supported by the hanging hook 50. If the basket 30 rotates, the position fixing part 35 positioned relatively in the front is hung on the guide part 43 of the elastic hook 46.

In this state, if a worker presses the position fixing part 35 in an arrow direction as shown in FIG. 3, the guide part 43 is elastically deformed and bent as shown in the drawing. And, as shown in FIG. 4, if the position fixing part 35 is firmly seated to the support rib 42, the guide part 43 is restored to its former state. The position fixing part 35 is coupled to be adhered to the hanging part 45, making it possible to prevent the upward and down ward shaking of the connect member 40.

Meanwhile, in order to decouple the coupling of the basket 30 and the connect member 40, the worker rotates the front end portion of the basket 30 centering on the rear end portion of basket 30 in the state where the guide part 43 is pressed and then elastically deformed. And, the position fixing part 35 is lifted up to be decoupled from the coupling with the hanging rib 44, thereby detaching the basket 30.

As described above, if the position fixing part 35 is coupled to the connect member 40, the shaking of the basket 30 is prevented when it is mounted. In other words, the shaking of the upper and lower ends of the position fixing part 35 is prevented by means of the elastic hook 46, the hanging hook 50 and the support rib 44, and the shaking of the front and rear ends of the position fixing part 35 is prevented by means of the hanging hook and the stopper 52.

Meanwhile, the elastic hook requires a predetermined force when the basket is inserted and it performs a function to inform that the basket is completely inserted by means of elastic restoration after the basket is completely inserted. Therefore, even when only the elastic hook is installed, a user may obtain sufficient satisfaction.

MODE FOR THE INVENTION

The present invention can further include another embodiments included in the scope of the present invention ideas, other than the preferable embodiment as described above.

First, although the position fixing part 35 is described to be formed in two positions, i.e., front and rear, of one hanging wire, it is not limited thereto but one position fixing part may be entirely extended forwardly and backwardly. In this case, the number of positions where the hanging wire is engaged with the basket is reduced so that it may cause a problem that the engagement strength drops. However, at this time, the end portion of the hanging wire is bent and extended in up and down directions, and the extended end portion is additionally engaged with the basket, making it possible to secure sufficient strength.

Also, the hanging ribs are formed in the front and the rear of the connect member, respectively, by ones, for preventing the right and left shaking of the basket, and the hanging hook and the stopper are formed in the front and the rear of the connect member, respectively, by ones, for preventing the front and rear shaking of the basket. And, the elastic hook is formed in the front of the connect member by one for preventing the up and down shaking of the basket, and furthermore, the end portion of the hanging hook in the rear of the connect member is further extended forward at a predetermined length for preventing the up and down shaking of the basket. Among others, the hanging rib may be formed in one or three or more, however, preferably, two, for the safe supporting operation and economic reason. The elastic hook is a member for improving a user's satisfaction, securing the accuracy of the firm attachment, and knowing a mounting state of the basket by the user, wherein it is preferable to be provided in one however, it is also available to be installed in two or more. For example, in the case where the elastic hook is further provided in the rear of the connect member, it is possible to instruct a state where the rear portion of the basket is firmly seated so that it is convenient for the user.

Also, even though a pair of elastic hook 46 are installed in one surface of the connect member 40, not formed with the hanging hook 50, the operation proposed in the present invention can be performed. However, in this case, it should be the case sufficiently limiting the rear move of the basket by means of the hanging rib 44.

Also, in the case where the support rib 42 is extended into the inner side more than a predetermined length, the basket can be safely supported even though the hanging rib is not provided. However, since the reliability of fall prevention of the basket is improved by being provided with the hanging rib, of course, it is more preferable.

Also, the basket proposed in the preferable embodiment is provided in a shape where a strand of long frame wires are laterally projected, wherein a projected portion, that is, a position fixing part is in a structure to be firmly seated to a connect member. With such a structure, even when the present invention is provided with only a member limiting the front and rear move of the position fixing part, it may solve the problems occurred in the prior hook structure such as coming off of the coating of the wire and generation of rust, etc.

Also, even in the case where the hanging structure provided in the present embodiment is adopted on one side of the basket and another engagement structure is adopted on the other side thereof, the idea of the present invention can be naturally applied.

INDUSTRIAL APPLICABILITY

With the present invention, when moving a basket provided in a refrigerator, the shaking of the basket is prevented, the fall of the basket is prevented, the foods inside the basket are safely supported, the reliability for the basket support is improved, the coming off of the coating generated by means of wires, etc. and the generation of rust resulted thereby are prevented, making it possible to obtain advantages of improvement of user's sanitation and the improvement of appearance.

The invention claimed is:

1. A mounting apparatus for a basket for a refrigerator comprising:

a rail member adapted to be mounted on a wall of the refrigerator to be retractable;

a connect member engaged with the rail member; and a basket of which a side is provided with a position fixing part to be firmly seated to the connect member, at least one portion of the position fixing part being laterally projected, wherein, in order to support the position fixing part, the connect member includes:

a right and left shake preventing part preventing right and left shakings of the position fixing part, the right and left shake preventing part having a hanging rib configured to support the position fixing part;

a front and rear shake preventing part preventing front and rear shakings of the position fixing part; and an up and down shake preventing part preventing up and down shakings of the position fixing part, the up and down shake preventing part including:

an elastic hook disposed to be separate from the hanging rib, the elastic rib having a guide part including a slant surface on which the position fixing part is slidable and a hanging part extending from the end of the guide part to support the position fixing part; and a support rib oriented in a parallel direction with respect to the hanging part to support the position fixing part, wherein the hanging rib is protruded from the support rib, and the guide part is elastically deformed to allow a spacing between the elastic hook and the hanging rib to increase when the position fixing part is coupled to the connect member, and wherein a side part of the position fixing part is supported by the hanging rib, and an upper part and a lower part of the position fixing part are supported by the hanging part and the support rib therebetween when coupling of the position fixing part with the connect member is completed.

2. The mounting apparatus as claimed in claim 1, wherein the front and rear shake preventing part comprises a hanging hook formed in the rear of the connect member.

3. The mounting apparatus as claimed in claim 2, wherein the hanging hook includes a portion that projects upwardly and a portion that extends at a slant from the upwardly projected portion towards the front of the connect member to prevent the firm seat of the basket.

4. The mounting apparatus as claimed in claim 2, wherein the hanging hook includes a portion that is slanted to prevent the up and down shaking of the basket.

5. The mounting apparatus as claimed in claim 1, wherein the front and rear shake preventing part comprises a stopper provided in the front of the connect member.

6. The mounting apparatus as claimed in claim 1, wherein the position fixing part includes a pair of position fixing parts, one of the pair of position fixing parts being formed in a front portion of a side of the basket and another of the pair of position fixing parts being formed in a rear portion of the side of the basket.

7. The mounting apparatus as claimed in claim 1, wherein the elastic hook is pressable to be elastically deformed when the mounting operation of the basket is performed and is elastically restored when the basket is completely mounted.

8. The mounting apparatus as claimed in claim 7, wherein, after being completely inserted, the elastic hook contacts one portion of the basket to support the basket.

9. The mounting apparatus as claimed in claim 1, wherein the elastic hook is provided in a front portion of the connect member.

* * * * *